US006010268A

United States Patent [19]

Sereg et al.

[11] Patent Number: 6,010,268

[45] Date of Patent: Jan. 4, 2000

[54] SPONGE APPLICATOR DEVICE

[75] Inventors: Michael Sereg, Laguna Niguel; Lloyd Askew, Anaheim, both of Calif.

[73] Assignee: Prolong Super Lubricants, Inc., Irvine, Calif.

[21] Appl. No.: 09/213,302

[22] Filed: Dec. 15, 1998

[51] Int. Cl.[7] ..... A47L 13/17; A47L 13/46

[52] U.S. Cl. ..... 401/207; 401/140; 401/196; 401/266; 15/244.1

[58] Field of Search ..... 401/207, 266, 401/140, 196; 15/244.1, 244.2, 244.3

[56] References Cited

U.S. PATENT DOCUMENTS

| | | | |
|---|---|---|---|
| 211,104 | 1/1879 | Mulford . | |
| 1,334,911 | 3/1920 | Lampkin | 401/266 |
| 1,586,337 | 5/1926 | Stockwell | 15/244.2 |
| 1,631,133 | 6/1927 | Jones | 15/244.1 |
| 2,118,051 | 5/1938 | MacMichael | 401/266 |
| 2,281,367 | 4/1942 | Moll | 401/207 X |
| 2,829,393 | 4/1958 | Turcotte | 401/207 |
| 2,947,015 | 8/1960 | Burt . | |
| 2,962,743 | 12/1960 | Henriksson | 401/266 |
| 3,319,281 | 5/1967 | Montgomery | 15/244.1 |
| 3,340,561 | 9/1967 | Schwartzman . | |
| 3,418,055 | 12/1968 | Schwartzman . | |
| 3,847,151 | 11/1974 | D'Alessandro | 401/207 X |
| 4,008,968 | 2/1977 | Hobbs | 401/207 |
| 4,368,746 | 1/1983 | Spatz . | |
| 4,389,132 | 6/1983 | Valadez . | |
| 4,483,636 | 11/1984 | Meyer | 401/207 X |
| 4,693,623 | 9/1987 | Schwartzman . | |
| 4,706,807 | 11/1987 | Andres . | |
| 4,856,136 | 8/1989 | Janssen | 15/244.1 |
| 4,886,388 | 12/1989 | Gulker et al. | 401/207 X |
| 4,934,011 | 6/1990 | Haug | 401/207 X |
| 5,018,894 | 5/1991 | Goncalves . | |
| 5,197,815 | 3/1993 | Sibley . | |
| 5,240,339 | 8/1993 | DeForest et al. . | |
| 5,328,283 | 7/1994 | Viens . | |
| 5,353,819 | 10/1994 | Kahn et al. . | |
| 5,823,206 | 11/1996 | Mapleback . | |

*Primary Examiner*—Steven A. Bratlie
*Attorney, Agent, or Firm*—Fulwider Patton Lee & Utecht, LLP

[57] ABSTRACT

An applicator device wherein a handle component has an easily removable sponge component. The sponge component includes a relatively stiff closed cell base layer and one or more relatively compliant, open cell layers laminated thereto. The sponge is retained on the handle by the cooperation of a retaining bead formed in raised section on the handle component with an aperture in the sponge component formed in the base layer.

11 Claims, 2 Drawing Sheets

SPONGE APPLICATOR DEVICE

BACKGROUND OF THE INVENTION

The present invention generally relates to sponge applicators and more particularly pertains to the attachment of a sponge to a handle.

It is well known to attach a sponge to a handle including a handle that is configured to simultaneously serve as a fluid reservoir. Such combination provides a convenient dispenser/applicator that is well suited for a wide variety of applications and has been used to facilitate anything from shoe polishing to dishwashing. It is often also desirable to be able to replace the sponge quickly and easily as the sponge may wear out, may become contaminated or a sponge with different physical characteristics may be needed.

In heretofore known devices, the sponge component has been attached to the handle component in any of a variety of ways both permanently and removably. In devices with removable sponges, the use of clips, retainers or other hardware is typically relied upon which imparts undue complexity and inconvenience to its use and/or may increase the cost of manufacture.

What is needed, is a sponge/handle combination that allows an inexpensive and easily manufactured sponge component to be quickly and easily removed and replaced without the manipulation of any extraneous hardware.

SUMMARY OF THE INVENTION

The present invention provides a sponge handle configuration that overcomes the disadvantages associated with prior art devices. The configuration allows the sponge to be quickly and easily removed from, as well as, attached to the handle component. No additional hardware components are employed as the sponge component attaches directly to the handle component. The device is therefore easy to use and inexpensive to manufacture.

The device of the present invention generally consists of two components. A handle component, which may or may not be configured so as to also serve as a fluid container and a removable sponge component. The two components are directly coupled to one another.

The handle component has a flat receiving surface with a raised section formed therein. Such raised section in turn has a retaining bead formed about its periphery that extends radially outwardly in parallel relative to the receiving surface.

The sponge component generally consists of a lamination of different foam materials. The base layer that is positioned directly adjacent the receiving surface of the handle component is a relatively stiff closed cell material while an applicator layer is laminated directly thereover which is considerably more compliant and has an open cell configuration. Such applicator foam material is selected for its suitability for applying a particular material to a particular type of surface. The stiff closed cell layer has an aperture formed therein that is dimensioned to tightly conform to the cross-section of the raised section below the lip. The applicator layer may or may not have a recess formed therein to accommodate the intruding raised section. An intermediate foam layer may optionally be sandwiched between the closed cell base layer and the open cell applicator layer. Such optional intermediate layer serves to space the applicator layer completely above the inserted raised section and obviates any need to form a recess in the applicator layer.

By forcing the raised section of the handle into the receiving aperture formed in the base layer of the sponge component, the retaining bead causes such material to temporarily deform as it is forced therethrough and into the layer adjacent thereto. Upon regaining its original size and shape, the stiff layer of foam serves to retain the bead and hold the sponge component on the handle.

These and other features and advantages of the present invention will become apparent from the following detailed description of preferred embodiments which, taken in conjunction with the accompanying drawings, illustrate by way of example the principles of the present invention.

DETAILED DESCRIPTION OF PREFERRED EMBODIMENTS

The figures generally illustrate the sponge applicator device of the present invention, and more specifically, illustrate the preferred embodiments well suited for the application of, for example, liquid compositions for the treatment of an automobile's finish. The handle component is first filled with the liquid composition and then inverted and squeezed to force the liquid into the sponge component. As the sponge surface is wiped over the surface and the liquid retained therein becomes depleted, the handle is periodically squeezed to dispense more of the liquid as it is needed.

Figure 1:
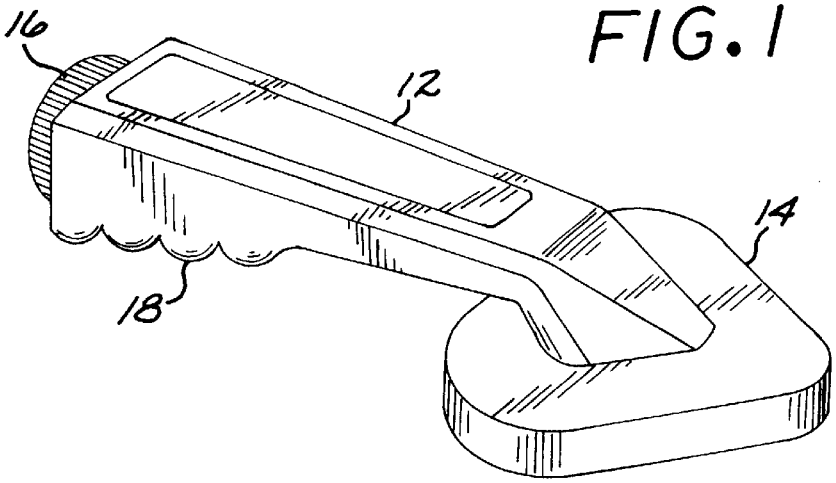
FIG. 1 is a perspective view of the sponge applicator device of the present invention.

FIG. 1 illustrates the device in its assembled state wherein the hollow plastic handle component 12 is attached to the sponge component 14. The handle is fillable by removal of screw cap 16. Liquid is dispensed directly into the sponge component 14 by inverting the device and squeezing the handle.

Figure 2:
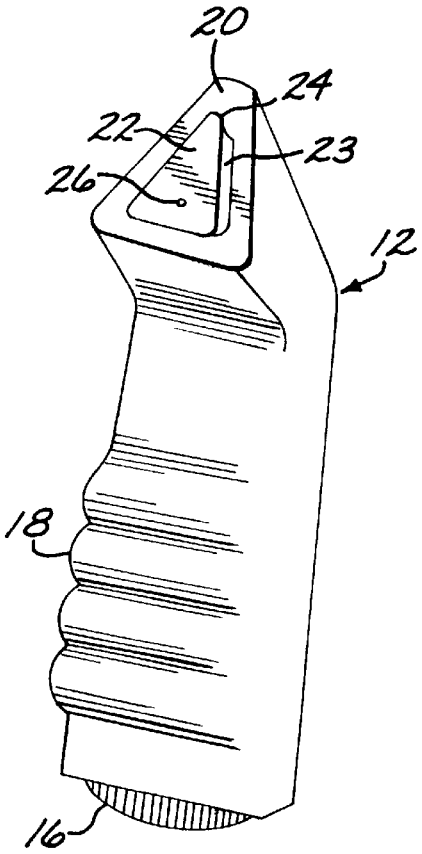
FIG. 2 is a perspective view of the handle component.

FIG. 2 illustrates the handle component 12 sans sponge component. The handle has a finger grip 18 formed in its body and is angled to terminate in a flat receiving surface 20. A raised section 22 extends above the receiving surface. Such raised section includes a trunk portion 23 and a head portion 24 wherein the cross-section of the head portion is greater than the trunk portion to thereby define a retaining bead. The shape of the raised section is non-circular to prevent rotation of the sponge component when it is attached thereto. In the embodiment shown, the raised section is generally triangular in shape. One or more orifices 26 are formed in the face of the raised section to permit the dispensation of liquid from within the interior of the handle.

Figure 3:
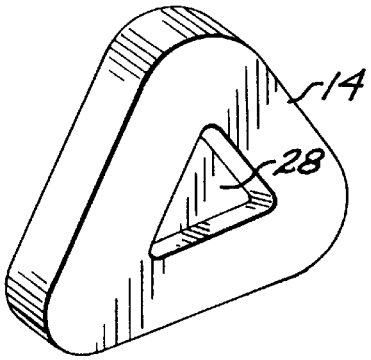
FIG. 3 is a perspective view of the sponge component.
Figure 4:
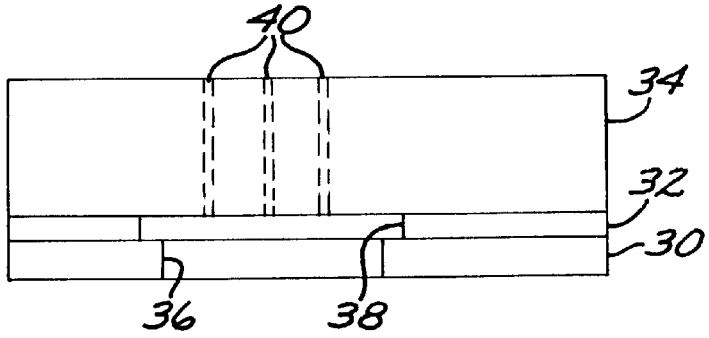
FIG. 4 is an enlarged cross-sectional view of the preferred embodiment of the sponge component.
Figure 5:
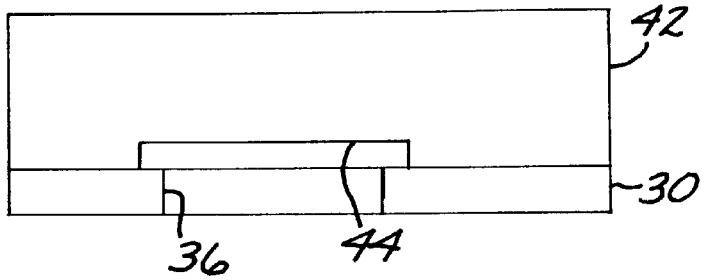
FIG. 5 is an enlarged cross-sectional view of an alternative embodiment of the sponge component.
Figure 6:
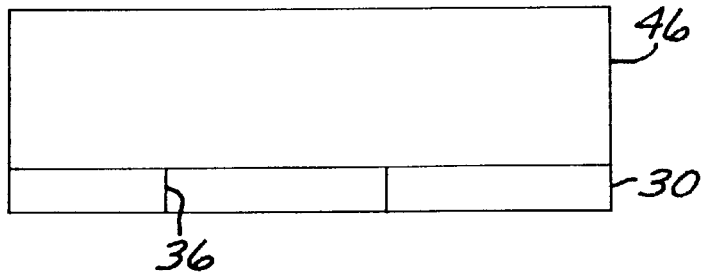
FIG. 6 is an enlarged cross-sectional view of another alternative embodiment of the sponge component.

FIG. 3 illustrates the side of the sponge component 14 that mates with the handle component 12 with the recess 28 formed therein being clearly visible. FIGS. 4–6 are cross-sectional illustrations of three alternative embodiments of the sponge component. FIG. 4 shows a three layer embodiment of the sponge component wherein a relatively stiff closed cell base layer 30 is laminated to a relatively compliant intermediate layer 32 which in turn is laminated to relatively compliant applicator layer 34. The base layer 30 has an aperture 36 formed therein that substantially corresponds to the cross-section of the trunk portion 23 of the handle's raised section 22. To achieve a tight fit and seal, the aperture is undersized by about 0.005". An aperture 38 is formed in the intermediate layer which substantially corresponds to the cross-section of the head portion 24 of the handle's raised section. The applicator layer 34 may optionally have ducts 40 formed therein to facilitate the flow of liquid to the surface.

FIG. 5 illustrates an alternative embodiment wherein only two layers of foam are employed. The same base layer 30 with aperture 36 is combined with an applicator layer 42 that has a recess 44 formed therein. The recess corresponds in height and in cross-section to the head portion 24 of the handle's raised section 22.

FIG. 6 illustrates another two layer alternative embodiment wherein the base layer 30 with the aperture 36 formed therein is laminated to an applicator layer 46 having no hole or recess formed therein.

Figure 7:
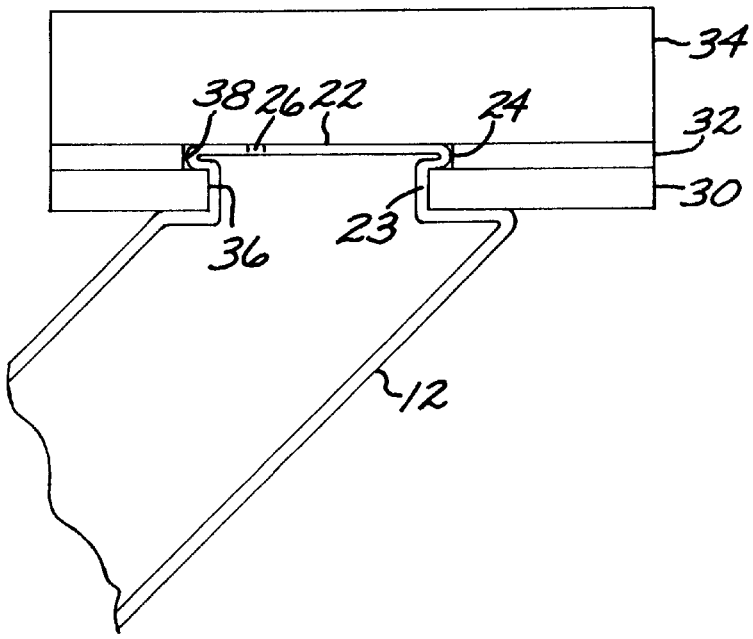
FIG. 7 is an enlarged cross-sectional view of the assembled handle component and the sponge component shown in FIG. 4.

FIG. 7 is a cross-sectional view showing the handle component 12 joined to the sponge component shown in FIG. 4. The base layer 30 is seated against receiving surface 20 and extends to the trunk portion 23 of the raised section. The head portion 24 of raised section 22 extends into the aperture 38 formed in the intermediate layer 32. In such position, the head portion 24 and more particularly, the retaining bead defined thereby, cooperates with the inside edge of the stiff base layer to retain the sponge component on the handle component. A similar cooperation of the raised section 22 with the base layer 30 is relied upon in all other embodiments of the invention to retain the sponge component on the handle component. In the case of the embodiment shown in FIG. 6, the raised section and more particularly the head portion that extends beyond the base layer serves to compress the relatively soft foam of the applicator layer so as to be accommodated therein.

The particular materials selected in the construction of the sponge component are dictated by the intended use of the device. It has been found that the combination of a 0.200" thick base layer of 8# polyethylene closed cell foam with a 0.100" thick intermediate layer of 2# polyester open cell foam and a 0.400" thick applicator layer of 2# polyester foam is ideally suited for the application of various paint treatments to an automobile's finish. In an application for dressing tires, a stiffer foam material is required in the applicator layer in order to prevent abrasion that would be caused by wiping the applicator surface across the various raised features molded into the side wall of a typical tire. The chemical properties of the particular composition to be dispensed also dictates the manner in which the foam layers are to be laminated to one another. Certain chemicals cause certain laminations to fail so an appropriate technique of the many techniques well known in the art must be selected. Possible options include, but are not limited to, hot melt lamination, flame lamination and use of a wet toluene adhesive.

In use, the sponge component 14 is simply pushed onto the raised section 22 of the handle component 12. The inherent, albeit limited pliability of the closed cell material of the base layer 30 allows the head portion 24 to be forced through aperture 36 while its resilience causes it to close in and around the trunk portion 23 of the raised section to hold the sponge component in place and form a seal. Filling the applicator handle with the liquid to be applied and inverting the assembly allows liquid to be dispensed upon squeezing the handle. Liquid issuing from orifice 26 diffuses throughout the open cell layer or layers (32,34,42,46),while the optional ducts 40 enhance its flow to the surface. The closed cell base layer 30 serves as a barrier to prevent the liquid from escaping upwardly as it is being applied. The pointed tip of the sponge component allows the liquid to be applied into confined areas.

While a particular form of the invention has been illustrated and described, it will also be apparent to those skilled in the art that various modifications can be made without departing from the spirit and scope of the invention. Accordingly, it is not intended that the invention be limited except by the appended claims.

What is claimed is:

1. A sponge applicator device, comprising:

a handle component having a support surface surrounding a raised section protruding thereform, such raised section having a trunk portion of relatively reduced cross-section and a head portion of relatively greater cross-section;

a sponge component including a base layer of relatively stiff closed cell foam material having an aperture formed therein substantially conforming in cross-section to that of the trunk portion of said raised section and an applicator layer of relatively compliant, open cell foam material laminated to said base layer whereby insertion of said head portion of said raised section through said aperture in said base layer causes said base layer to be supported by said support surface and retained by said head portion.

2. The applicator of claim 1 wherein said raised section has a non-circular cross-section to prevent rotation of said sponge component thereabout.

3. The applicator device of claim 1 wherein said handle component is hollow, has a sealable port for introducing a liquid thereinto and an orifice formed in said raised section for conducting liquid from within said handle into said sponge component.

4. The applicator of claim 3 wherein said raised section has a non-circular cross-section to prevent rotation of said sponge component thereabout.

5. The sponge applicator device of claim 1 wherein said applicator layer has perforations formed therein extending between said aperture in said base layer and the surface of said applicator layer.

6. The sponge applicator device of claim 1 wherein said applicator layer has a recess formed therein, oriented and dimensioned to receive said raised section.

7. The sponge applicator device of claim 6 wherein said applicator layer has perforations formed therein extending between said recess and the surface of said applicator layer.

8. The sponge applicator device of claim 1 wherein an intermediate foam layer is sandwiched between said base layer and said applicator layer and said intermediate layer has an aperture formed therein, axially aligned with the aperture formed in said base layer and dimensioned to accommodate said head portion of said raised section.

9. The sponge applicator device of claim 8 wherein said applicator layer has perforations formed therein extending between said aperture in said intermediate layer and the surface of applicator top layer.

10. The applicator device of claim 1 wherein said sponge component is non-circular with at least one elongated apex.

11. The applicator device of claim 1 wherein the aperture formed in said closed cell material is sufficiently undersized to form a seal with the trunk portion of said raised section.

* * * * *